US005413414A

United States Patent [19]

Bauer

[11] Patent Number: 5,413,414

[45] Date of Patent: May 9, 1995

[54] GUIDE SLEEVE FOR A LENGTH-ADJUSTABLE COLUMN FOR CHAIRS OR TABLES

[75] Inventor: Hans J. Bauer, Altdorf, Germany

[73] Assignee: Suspa Compart Aktiengesellschaft, Altdorf, Germany

[21] Appl. No.: 8,569

[22] Filed: Jan. 22, 1993

[30] Foreign Application Priority Data

Jan. 25, 1992 [DE] Germany ..... 9200884 U

[51] Int. Cl.[6] ..... F16C 33/02; F16M 11/00; A47C 3/00

[52] U.S. Cl. ..... 384/276; 248/161; 297/344.18; 384/291; 384/295

[58] Field of Search ..... 384/13, 26, 29, 32, 384/34, 276, 286, 291, 295; 248/161, 157; 297/344.12, 344.18, 344.19

[56] References Cited

U.S. PATENT DOCUMENTS

| | | | |
|---|---|---|---|
| 1,377,866 | 5/1921 | White | 384/291 |
| 2,348,274 | 5/1944 | Aker | 384/291 X |
| 2,539,782 | 1/1951 | Kell | 384/276 |
| 3,711,054 | 1/1973 | Bauer | 248/400 |
| 3,923,280 | 12/1975 | Good | 297/344.18 X |
| 4,899,969 | 2/1990 | Bauer | 248/161 |
| 4,969,619 | 11/1990 | Bauer et al. | 297/344.19 X |
| 4,979,718 | 12/1990 | Bauer et al. | 248/631 |
| 5,131,615 | 7/1992 | Hosen et al. | 384/32 X |
| 5,152,646 | 10/1992 | Bauer | 409/244 |

FOREIGN PATENT DOCUMENTS

| | | | |
|---|---|---|---|
| 139045 | 12/1978 | Japan | 384/291 |

*Primary Examiner*—Thomas R. Hannon
*Attorney, Agent, or Firm*—Browdy and Neimark

[57] ABSTRACT

A guide sleeve for a length-adjustable column for chairs is provided with an outside to be received and supported in a guide tube of the column. The guide sleeve is further provided with an internal surface, on which guide webs are formed which project towards a central longitudinal axis. The guide webs are separated from each other by recesses. On the guide webs, there are partial cylinder surfaces concentric of the axis and which are formed as guide surfaces for the housing of a length-adjustable element.

10 Claims, 1 Drawing Sheet

FIG. 1
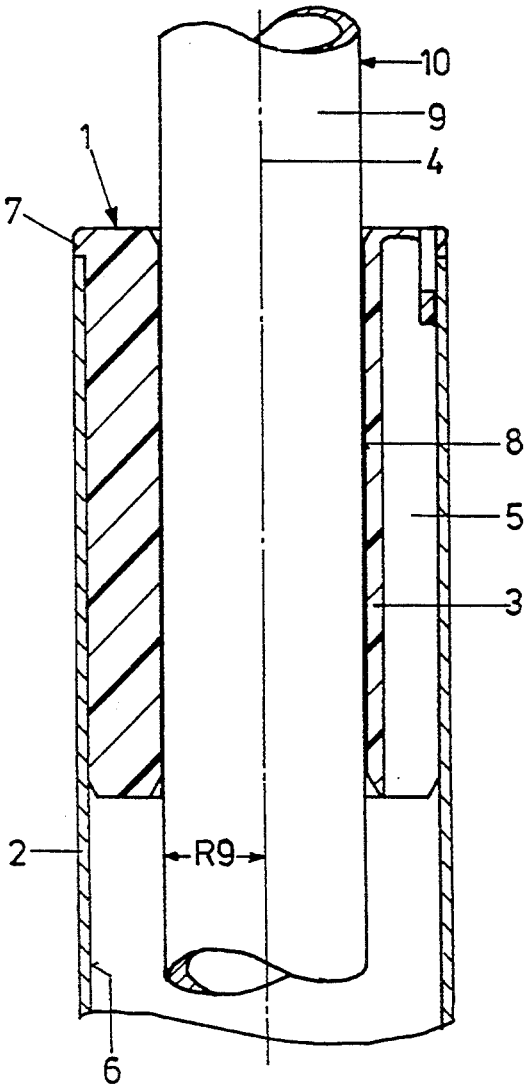
FIG. 2
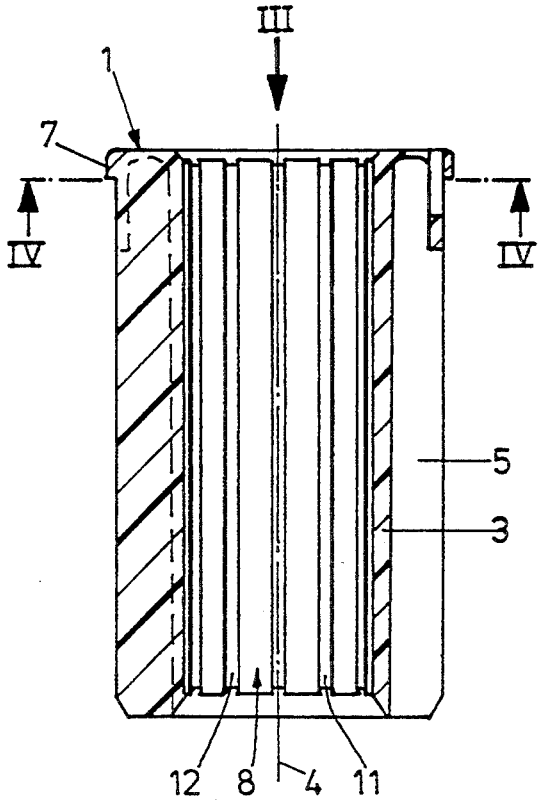
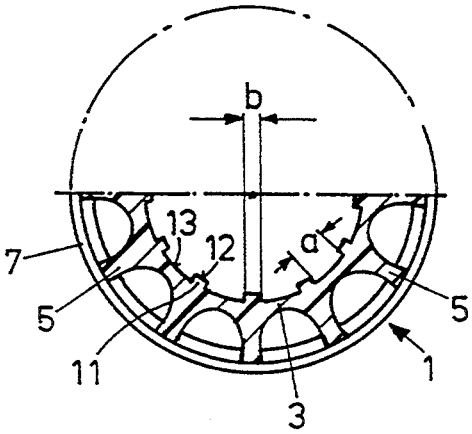
FIG. 4
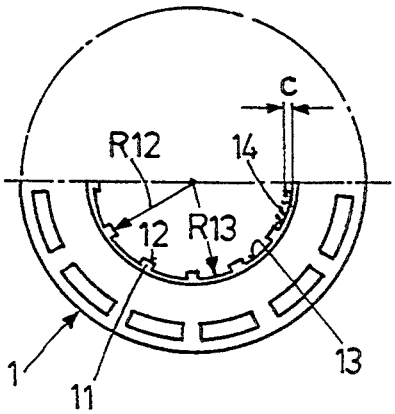
FIG. 3

GUIDE SLEEVE FOR A LENGTH-ADJUSTABLE COLUMN FOR CHAIRS OR TABLES

FIELD OF THE INVENTION

The invention relates to a guide sleeve for a length-adjustable column for chairs, tables or the like, of which the outside is formed to be received and supported in a guide tube of the column and which is provided on its internal surface with a guide surface concentric of a central longitudinal axis to guide a cylindrical housing of an adjusting element and which is made in one piece of plastic material.

BACKGROUND OF THE INVENTION

Columns of the generic kind as disclosed in U.S. Pat. No. 3,711,054 or U.S. Pat. No. 4,979,718 have an outer guide tube of metal, in the latter's upper portion facing away from a bottom plate, a guide sleeve of plastic material being arranged extending only over part of the length of the guide tube.

U.S. Pat. No. 5,152,646 has already proposed to shape such guide sleeves on their internal surface by broaching such that spread over the circumference, partial cylinder surfaces are provided as guide surfaces with recesses in between them, in which a lubricant can be stored.

SUMMARY OF THE INVENTION

It is an object of the invention to create a guide bush of the generic kind which is easy to manufacture and provides for precise and solid lateral guidance of the housing of the length-adjusting element.

This object is attained in accordance with the invention in that guide webs are formed on the internal surface which project towards the central longitudinal axis and which are separated from each other by recesses and in that, produced on the guide webs by chip removal, partial cylinder surfaces concentric of the axis are formed as guide surfaces for the housing. The measures according to the invention ensure that the chip removing processing, for instance by broaching, of the partial cylinder surfaces serving as guide surfaces secures the housing of the length-adjusting element being guided very precisely. The partial cylinder surfaces are very easily formed with high precision on the guide webs projecting radially from the internal surface of the guide bush without the chips resulting and being discharged during the processing causing crushings and thus surface damages. Together with the guide sleeve the guide webs are very rigid so that no inadvertent radial movements of the housing of the length-adjusting element are possible.

Further advantages, features and details of the invention will become apparent from the ensuing description of an example of embodiment taken in conjunction with the drawing.

BRIEF DESCRIPTION OF THE DRAWING

FIG. 1 is a partial section of a length-adjustable chair column with guide tube, guide sleeve and housing of a gas spring, FIG. 2 is a longitudinal section of the guide sleeve prior to the processing of the internal surface, FIG. 3 is a top view of FIG. 2 according to the arrow in FIG. 2, and FIG. 4 is a cross-section through the guide sleeve after the chip removing processing according to the section line IV—IV in FIG. 2.

DESCRIPTION OF THE PREFERRED EMBODIMENT

A guide sleeve 1 is arranged in a roughly outlined guide tube 2 of a length-adjustable chair column. Such chair columns are for instance known from U.S. Pat. No. 4,899,969, to which reference is made explicitly.

The guide sleeve 1 has a slide sleeve 3, on the outside of which rib webs 5 are formed protruding outwards radially in relation to the central longitudinal axis 4. By means of these rib webs 5 the guide sleeve 1 radially bears against the inside wall 6 of the guide tube 2. An upper annular collar 7 arrests the guide bush 1 in axial direction in relation to the guide tube 2. The guide sleeve 1 is entered into the guide tube 2 with press fit.

A housing 9 of a roughly outlined gas spring 10 is guided to slide on the internal surface 8 of the slide sleeve 3 in the direction of the axis 4. Together with the guide tube 2 and the guide sleeve 1 this gas spring 10 substantially forms the length-adjustable chair column in question. The housing 9 of the gas spring 10 can be the latter's direct housing or it can be an additional carrying tube surrounding the gas spring 10, as is equally known from U.S. Pat. No. 4,899,969, to which reference is also made explicitly.

The guide sleeve 1 consists of plastic material, preferably of a polyacetal, and is manufactured in one piece by injection-moulding. Guide webs 11 are formed on the internal surface 8 of the slide sleeve 3, they extend over the full axial length of the slide sleeve 3 and project radially from the internal surface 8 towards the axis 4. They are integrally formed with the slide sleeve 3. Prior to a to-be-described calibrating process by broaching, the guide webs 11 are oversize towards the axis 4. This is reduced by the broaching process, partial cylinder surfaces 12 then being formed on the guide webs 11, which are the actual guide surfaces vis-à-vis the housing 9 of the gas spring 10. Recesses 13 extend as parts of the internal surface 8 between adjacent guide webs 11. As for the radius R12 of the partial cylinder surfaces 12 from the axis 4 and the radial distance R13 of the recesses 13 from the axis 4 referred to the radius R9 of the housing 9, the relation $R13 > R12 \geqq R9$ applies, R12 being greater than R9 by a few hundredths of a millimeter at maximum, for instance by up to 0.05 mm.

As seen in FIG. 3 and 4, twelve guide webs 11 are provided at equal angular distances and extending parallel to the axis 4. In any case there should be at least six guide webs 11. The width a of the recesses 13 in the circumferential direction is about double the size of the width b of the partial cylinder surfaces 12. A lubricant 14 can be stored in the recesses 13.

For the broaching of the partial cylinder surfaces 12 a broach is used which has broaching teeth extending over its full circumference and having a circular blade. During the broaching process, any parts constituting the oversize in question are removed from the guide webs 11 by chip removal. The chips cut off have a width corresponding at maximum to the width b of the partial cylinder surfaces 12. The chips cut off adjacent partial cylinder surfaces 12 are interrupted in the area of the recess 13 located in between them. This kind of broaching of the partial cylinder surfaces 12 causes that the latter are broached to be very smooth with high surface quality, because the plastic chips resulting from the broaching can easily be discharged. There is no risk of their getting stuck between the cutting teeth of the broaching tool and the internal surface 8 of the slide sleeve 3 and damaging the surface of the partial cylinder surfaces 12.

The sum of the partial cylinder surfaces 12 forms the actual guide surface of the slide sleeve 3 vis-à-vis the housing 9 of the gas spring 10. The guide sleeve 1 in itself is extraordinarily stable. The housing 9 of the gas spring 10 being well guided is further aided in that the radial height c of the guide webs 11 is small in relation to the width b. $c<b$ applies, the relation being $R13-R12=c$. The stability is still increased by the guide webs 11 being arranged to radially overlap the ribs webs 5, so that guide forces extending radially to the axis 4 and exercised on the guide sleeve by the housing 9 via the guide webs 11 are in each case directly introduced into the rib webs 5 associated with the guide webs 11.

Fundamentally, any other appropriate chip-removing processing methods may be used instead of the described broaching, such as push-type broaching which is very much like press-type broaching.

While in the example of embodiment shown and described the guide webs 11 extend straight and parallel to the axis 4, they may also be wound, i.e. about helical and of great pitch. Suitably the pitch is at least such dimensioned that, over the length of the guide webs 11, two adjacent guide webs will overlap at least once. In this way it is attained that the housing 9 is radially supported by the partial cylinder surfaces at least over its entire circumference. Of course, the pitch may be even greater resulting in multiple overlapping of adjacent guide webs over the latter's length.

Emphasis is placed on that fact that a purely mechanical length-adjusting element, comprising for instance a mechanical spring and having a cylindrical housing or a cylindrical guide member for guidance on the partial cylinder surfaces 12, may be provided instead of a gas spring 10 as a pneumatic or hydropneumatic length-adjusting element. Fundamentally, the guide sleeve 1 of the described embodiment may also be used as a purely rotary guide, i.e. without the possibility of axial displacement.

What is claimed is:

1. A guide sleeve for a length-adjustable column for chairs or tables, of which an outside is formed to be received and supported in a guide tube (2) of the column and which is provided on an internal surface (8) with a guide surface concentric of a central longitudinal axis (4) to guide a cylindrical housing (9) of an adjusting element (10) and which is made in one piece of plastic material, wherein guide webs (110) are formed on said internal surface (8) which project towards the central longitudinal axis (4) and which are separated from each other by recesses (13) and wherein, produced on the guide webs (11) by chip removal, partial cylinder surfaces (12) concentric of the axis (4) are formed as guide surfaces for the housing (9) and wherein it is provided with rib webs (5) which project outwards radially to the central longitudinal axis (4) and wherein the guide webs (11) are arranged radially to the central longitudinal axis (4) each in alignment with the rib webs (5).

2. A guide sleeve according to claim 1, wherein the width (a) of the recesses (13) in the circumferential direction exceeds the width (b) of the partial cylinder surfaces (12) in the circumferential direction.

3. A guide sleeve according to claim 1, wherein a lubricant (14) is arranged in at least one of said recesses (13).

4. A guide sleeve according to claim 1, wherein the partial cylinder surfaces (12) are formed by broaching.

5. A guide sleeve according to claim 1, wherein the height (c) of the guide webs (11) in a direction radial to the central longitudinal axis (4) is smaller that the width (b) of the guide webs (11).

6. A guide sleeve according to claim 1, wherein—in each case referred to the central longitudinal axis (4)—the relation $R13>R12\geqq R9$ applies to the radius R12 of the partial cylinder surfaces (12) and to the radial distance R13 of the recesses (13) in relation to the radius R9 of the housing (9).

7. A guide sleeve according to claim 1, wherein the partial cylinder surfaces (12) are arranged at equal angular distances in relation to each other.

8. A guide sleeve according to claim 1, wherein the guide webs (11) with the partial cylinder surfaces (12) extend substantially over the full length of the guide sleeve (1).

9. A guide sleeve according to claim 1, wherein at least six guide webs (11) are provided.

10. A guide sleeve according to claim 1, wherein the guide webs (11) with the partial cylinder surfaces (12) are arranged straight and extending in parallel to the central longitudinal axis.

* * * * *